United States Patent [19]

Barlow et al.

[11] 4,250,656

[45] Feb. 17, 1981

[54] FIGURINE PUMP TOY

[75] Inventors: Gordon A. Barlow, Evanston; John R. Krutsch, Glenview; Michael J. Zidman, Deerfield, all of Ill.

[73] Assignee: Gordon Barlow Design, Skokie, Ill.

[21] Appl. No.: 46,795

[22] Filed: Jun. 8, 1979

[51] Int. Cl.[3] ..... A63H 29/16

[52] U.S. Cl. ..... 46/44; 46/116; 46/40

[58] Field of Search ..... 46/44, 116, 39, 40, 46/41, 87, 88, 22

[56] References Cited

U.S. PATENT DOCUMENTS

| | | | |
|---|---|---|---|
| 934,450 | 9/1909 | MacDonald | 46/44 UX |
| 2,853,829 | 9/1958 | Greene | 46/88 X |
| 3,090,156 | 5/1963 | Scoparino | 46/88 X |
| 3,721,039 | 3/1973 | Cook et al. | 46/116 |
| 4,216,610 | 8/1980 | Ferris | 46/44 |

*Primary Examiner*—Robert Peshock
*Assistant Examiner*—Mickey Yu
*Attorney, Agent, or Firm*—Alter and Weiss

[57] ABSTRACT

A family of games utilizing figurines that are also pneumatic pumps used for actuating miniaturized pneumatically operated equipment.

12 Claims, 7 Drawing Figures

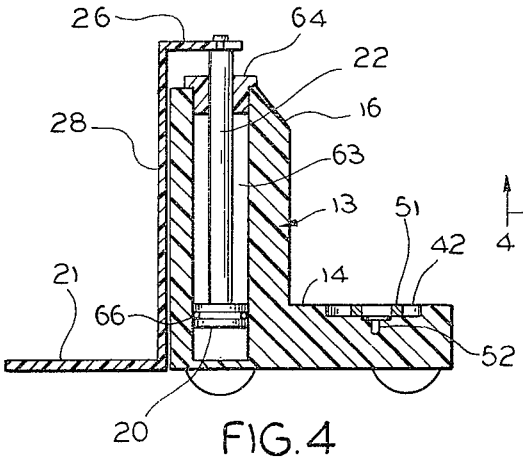
FIG. 4
FIG. 3
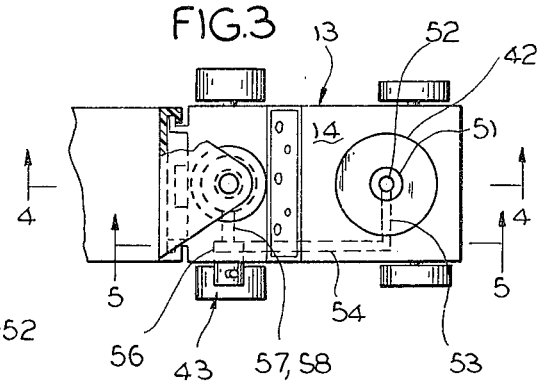
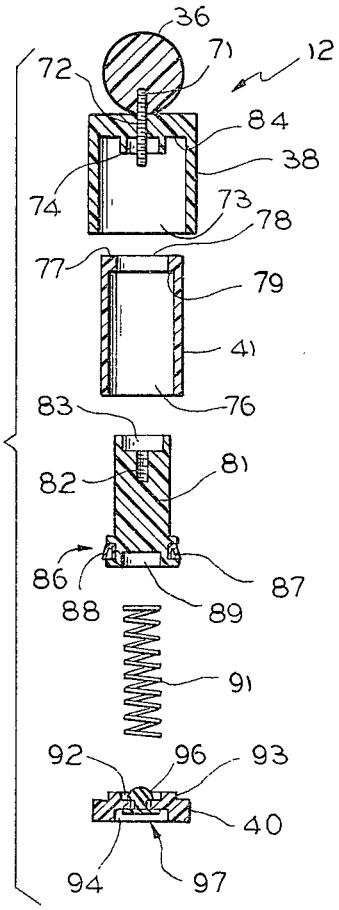
FIG. 6
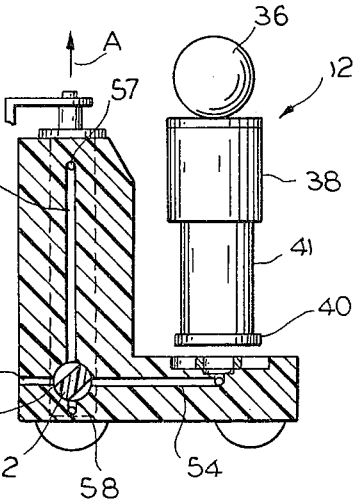
FIG. 5
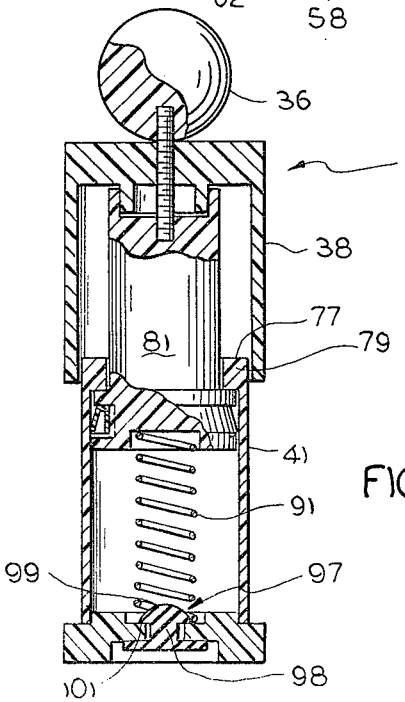
FIG. 7

FIGURINE PUMP TOY

This invention is concerned with toys; and more particularly, with toys utilizing dolls or figurines.

One of the oldest types of toys known to man are figurines or dolls. Children have always sought to imitate adults. One of the methods used by children to imitate the adults is by playing with dolls. The girls generally play with dolls that are in the form of babies; while boys play with dolls that are in the form of toy soldiers. When the girls are playing with such dolls, they are imitating their mothers. The boys are projecting themselves into the dolls. With both classes of dolls, the users are role playing.

There are, of course, many different types of dolls known. Some are totally inanimate; while others are completely mechanized. For example, the famous "RAGGEDY ANN" doll is a form of a totally inanimate doll. The mechanized dolls on the famous clocks in Europe are totally mechanized coming out of the clock at the appointed time, moving around the clock and returning to the doorway, for example.

Lately, dolls have even been given voices through the use of recorded tapes, and there are robot dolls that are actuated and operated by sound.

Mechanized dolls in general, in the past, first operated off the potential energy of a spring. Subsequently, with the invention and perfection of batteries, they were and are operated electrically. The operation by a spring requires constant winding of the spring, and the electrical operation, of course, requires either changing the batteries or recharging the batteries. Of course, that is detrimental to the enjoyment of the toy.

Accordingly, an object of the present invention is to provide new and unique types of mechanized toys that require neither batteries nor springs for its potential energy.

Another object of the present invention is to provide new and unique dolls that are used to operate miniaturized automatic equipment.

Yet another object of the present invention is to provide a family of such dolls that are the source of power used in operating a variety of automatic equipment.

Still another object of the present invention is to provide a variety of figurines that are used to operate many different types of mechanized equipment.

Still another object of the present invention is to provide new and unique dolls that have equal appeal for boys and girls since they can be used as the role representative for projection by either boys or girls.

In a preferred embodiment of the present invention the dolls, called "workables", represent either males or females and are actually pneumatic pumps. The equipment, be it a pneumatic egg beater or a pneumatic lift truck, is operated by one of the dolls representing either a homemaker-type female in the kitchen or a brawny-type male driving a lift truck.

The pneumatic pump is operated by pushing down on the figurine, which forces down a piston in a cylinder. The outlet of the figurine cylinder includes a one-way valve that is coupled to a drive piston or impeller for operating various and sundry equipment.

The above-mentioned and other objects and features of the present invention will be best understood by making reference to the accompanying drawings, wherein:

FIG. 3 is a plan view of the lift truck showing the pneumatic paths therein in dashed line form;

FIG. 4 is a cross sectional view of the lift truck taken along lines 4—4 in FIG. 3 and looking in the direction of the arrows;

FIG. 5 is a sectional view of the lift truck taken along lines 5—5 of FIG. 3 and looking in the direction of the arrows with a "workable" figurine just removed from its working position in the lift truck;

FIG. 6 is an exploded view of a "workable" figurine; and

FIG. 7 is an assembled sectional view of the "workable" figurine.

Figure 1:
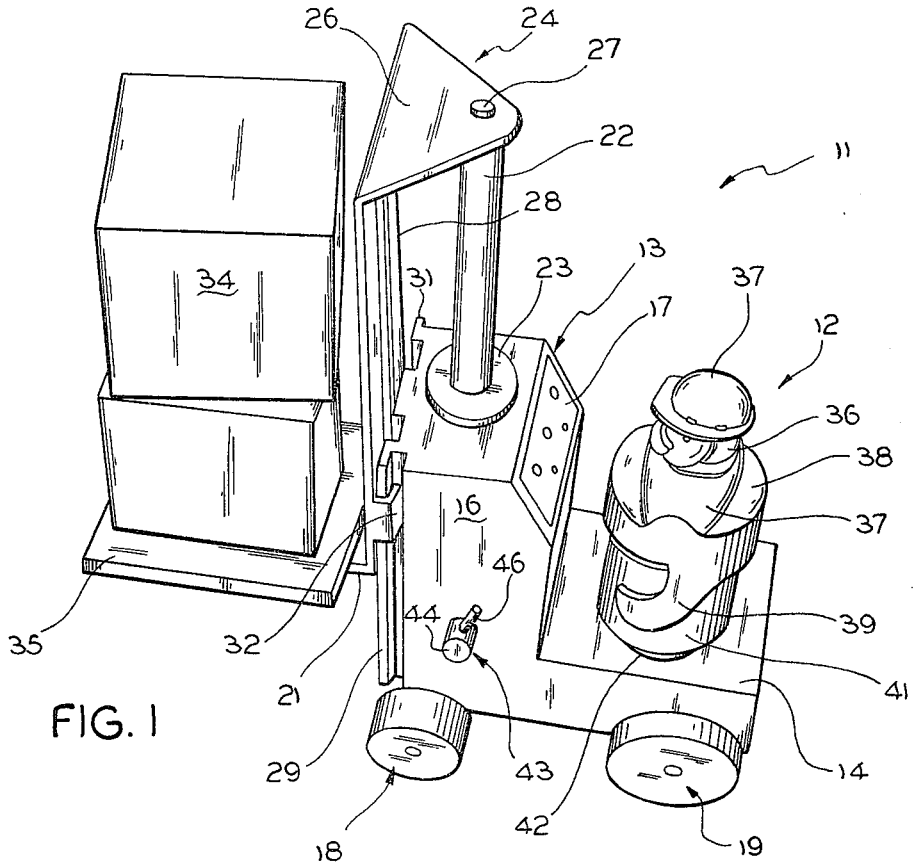
FIG. 1 is a pictorial view of one embodiment of a "workable" figurine used in conjunction with a miniaturized lift truck shown with its lift in the raised position.

The workable toy system 11 shown in the figures herein represents a sample of the many different embodiments the workable toy systems can assume.

In the system 11 a "workable" figurine 12 representing a lift truck operator is shown in position to operate the lift truck 13. More particularly, the figurine 12 is mounted on the lift truck operating platform 14. The lift truck 13 is shown as having the platform 14 extending from the basic upstanding body 16. The basic body is shown as having a control panel 17 to enhance the imagination of the individual playing with the system.

Two sets of wheels 18 and 19 provide mobility to the lift truck. A lift platform 21 is arranged to be moved up and down with lift truck piston 22 which extends from an orifice 23 in the basic body 16 of the lift truck 13.

The platform 21 is shown as being the bottom portion of a modified Z-shaped bracket 24. The Z-shaped bracket has a top horizontal section 26 affixed to the top of piston 23 by means, such as rivet or screw 27. A vertical section 28 of the bracket 24 connects the top horizontal section 26 to the bottom horizontal platform 21.

Means are provided on the basic body section 16 of the lift truck 13 for guiding the bracket 24 during its vertical movement. More particularly, a pair of rails 29 and 31 are shown at the front of the body section 16 of the lift truck 13. Rail riding brackets, such as L-shaped bracket 32, extends from vertical section 28 of the substantially Z-shaped bracket 24 to slidingly affix the bracket 24 to the rails.

The "workable" figurine 12 is shown as having a head section 36 with a helmet 37 thereon. Immediately below the head section 36 is a shoulder section 35 raised from the main upper torso section 38. Arms, such as arm 39, extend down from the upper torso 38 reaching over the lower torso section 41. The bottom of the lower torso section fits into a shallow well 42 in platform 14. The fit is close enough to retain the figurine in the platform.

As will be explained further, the workable figurine 12 is the source of the pneumatic force for lifting the piston 22.

Means are provided for enabling the piston 22 to move down after it has been forced upward. More particularly, a valve is provided that is controlled by valve control unit 43. The valve control unit comprises a cylindrical section 44 with a handle 46 extending therefrom. When the handle is in the position shown in FIG.

Figure 2:
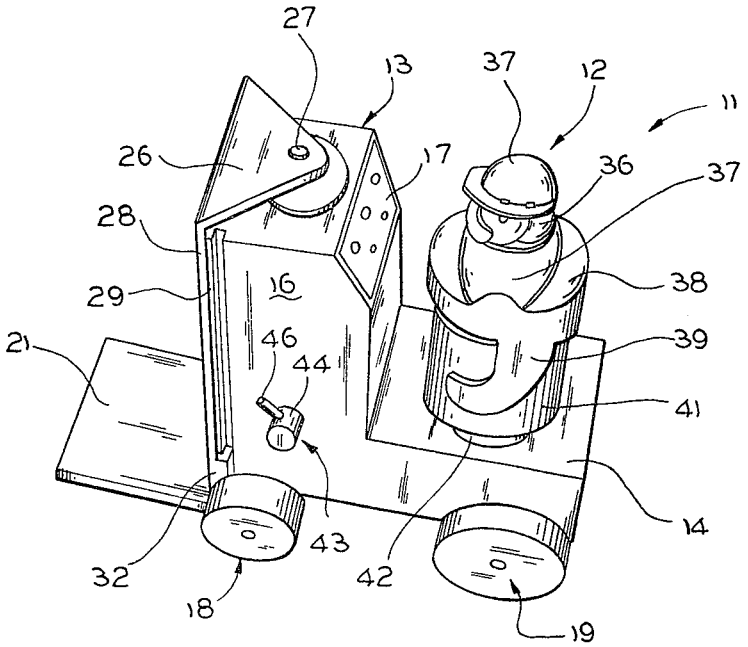
FIG. 2 is the pictorial illustration of the "workable" figurine of FIG. 1 shown with a miniaturized lift truck having its lift in the lowered position.

1, then air originated at figurine 12 is directed to force piston 22 upward. When the control 43 is in the position shown in FIG. 2, then the air in the cylinder holding piston 22 in the raised position is bled away and the piston lowered along with whatever is on the platform 21.

In FIG. 3 the dashed lines illustrate the fluid path. The well 42 in operator's platform 14 of lift truck 13 is shown as including an inner nesting well 51. The center of the inner nesting well includes passageway 52 leading to a transverse tube or passage 53, which is shown as going to a passage or tube 54 that leads to the valve 56.

Valve 56 is controlled by the valve control unit 43. From the valve, passages extend to the bottom of the cylinder and to the top of the cylinder. The passages to the cylinder are indicated at 57 and 58. The passage 57, as seen in FIG. 5, is the passage to the top of the cylinder. The passage 58 is the passage to the bottom of the cylinder. A passage or tube 59 leads from valve 56 to passage 57. A passage to the atmosphere from valve 56 is shown at 61. The valve core 62 is moved over a range of 90 degrees by valve control 93 for effective valve control action.

In the position shown in FIG. 5 air from the "workable" figurine is led through passage 54 and directly by valve 56 through passage 58 to the bottom of cylinder 63. Therefore, the piston is forced upward, as indicated by arrow A. When the valve core 62 is moved 90 degrees, then air from the "workable" figurine is directed through passages 59 and 57 to the top of cylinder 63 forcing the piston downward. In each case air from the cylinder passes through passages or tube 61 to the atmosphere.

The cylinder 63 is capped by head 64, as shown particularly in FIG. 4. The piston rod 22 slip fits in aperture 23 enabling the movement of the piston through the head. The piston rod 22 is attached to the piston 20. The piston 20 is shown equipped with O-ring 66 to minimize leakage around the piston. It should be understood that the leakage around the piston could be adjusted to eliminate the need for the valve and/or air passage 61.

The exploded view of the "workable" figurine 12, shown in FIG. 6, is an undecorated figurine. In other words, there are no frills, such as helmets or limbs, to interfere with the understanding of the operation of the figurine.

The head 36 is shown as a sphere having a screw rod 71 affixed therein. The top torso section 38 has a hole 72 therein large enough for the threaded rod 71 to pass therethrough. The top torso section 38 is shown as being basically cylindrically shaped; however, it could, of course, be rectangularly shaped; just so the parts of the figurine fit together operatively. The top cylindrical torso section 38 is shown as being open at the bottom part 73. The upper closed part has a downwardly depending cylindrical section 74 therein.

The bottom section 41 which acts as a cylinder is shown as also cylindrically shaped having a completely open bottom section 76 and a partially open top section 77. A hole 78 leaves a cylindrical flange 79 at the top section 77 of bottom cylinder section 41.

A coupling piston 81 is shown as also being cylindrically shaped. It is basically a solid piece having a threaded hole 82 at the top thereof. The hole 82 is dimensioned to threadingly receive screw rods 72 therein. Immediately above the threaded hole is a larger clearing aperture 83 dimensioned to fit around downwardly depending cylindrical section 74.

When the screw rod 71 is threaded into a hole 82, it forces the clearing aperture 83 of coupling piston 81 to surround the downwardly depending cylindrical section 74 assuring a stable coupling of the parts of the figurine. The bottom 86 of coupling piston 81 has a peripherally grooved flange section 86. The groove 87 receives a lip seal 88 therein which minimizes the amount of air that can pass the flange as the flange moves downward in the cylinder section 41, but enables the passage of air as the piston 81 moves upward.

The very bottom of coupling piston 81 contains a shallow aperture 89 for receiving resilient means, such as spring 91, therein. The top of the spring thus fits into the spring receiving aperture 89. The bottom of the spring 91 fits into a shallow aperture 92 defined by upraised cylindrical section 93. The bottom of base 40 also contains a shallow aperture 94. This shallow aperture 94 is dimensioned for receiving inner nesting well 51, while the outer dimensions of base 40 fit into well 42. Apertures 92 and 94 are connected together by aperture 96.

Aperture 96 contains check valve means. More particularly, the valve comprises a pliable plug means 97 having a cylindrical center section 98 which fits into aperture 96. A rounded mushroom shaped top 99 prevents plug 97 from passing through aperture 98. However, it is notched to enable air to pass through aperture 96 around cylindrical section 98. The bottom of the plug is a flat section 101 which completely covers aperture 96 and prevents air from coming from the passages of the lift truck or the like into the workables.

Thus, as is most clearly shown in the assembled figurine of FIG. 7, when the head 36 of the figurine is pressed down, then the upper torso 38 and piston section 81 move downward along bottom torso cylinder 41, forcing air that is within the hollow bottom torso section 41 out through the check valve means 97 and into tube 52. The spring 91 keeps the upper torso section in its normally raised position.

In its assembled position, the flange section 79 locks onto the peripheral flange 86 piston section 81. The upper torso 38 is held in place by piston section 81, which in turn is held in the upraised position by spring 91.

The figurines can depict many imaginary operative characters. By way of example, the figurines can depict firemen and operate hook and ladder trucks, raising ladders and/or snorkle hose arrangements. The basic principle is the same as that described herein in connection with the lift truck operator and lift truck system.

While the principles of the invention have been described above in connection with specific apparatus and applications, it is to be understood that this description is made by way of example only and not as a limitation on the scope of the invention.

What is claimed is:

1. A toy system, said system comprising one or more figurines, said one or more figurines formed by at least two co-operating figurine elements;

fluid pump means integral to said figurines, said fluid pump means formed by said two or more cooperating figurine elements so as to preclude the need for independent pump means therefor;

pressurized fluid operated equipment, and interfacing means for interfacing said fluid pump means and said pressurized fluid operated equipment, whereby the actuation of said pump means provides pressurized fluid which operates said pressurized fluid operated equipment.

2. The toy system of claim 1 wherein said fluid pump means comprises pneumatic pump means, and wherein said pressurized fluid operated equipment comprises pneumatically operated equipment.

3. The toy system of claim 2 wherein said figurines comprise cylinder means, piston means within said cylinder means, and pressurized fluid outlet means in said cylinder at the interface means between said equipment and said figurines.

4. The toy system of claim 3 including check valve means at said fluid outlet.

5. The toy system of claim 4 wherein at least a section of said piston means is slip-fitted within said cylinder means, peripheral radial groove means in said section of said piston means, lip seal means in said groove means, whereby when said piston is operated in a first direction fluid is deterred from passing around said piston and when said piston is operated in a second direction fluid is enabled to pass around said piston means.

6. The toy system of claim 5 including resilient means normally positioning said piston means at one side of said cylinder means, whereby when said pump means is actuated, said resilient means is strained.

7. The toy system of claim 4 wherein said fluid outlet means comprises an opening at one end of said cylinder, said opening being substantially I-shaped with a wide top section, a wide bottom section and a narrow center section, said check valve means comprised of resilient material being substantially in the shape of a mushroom on a relatively large flat base, said mushroom shaped check valve means having a wide top on a narrow stem, the top of said mushroom being positioned in the top section of said I-shaped aperture, the stem of the mushroom being positioned in the narrow center section in the wide bottom section, and grooves in said substantially mushroom shaped valve means extending from the wide top to the stem, whereby pressurized fluid from the cylinder forces the base away from the aperture and prevents fluid from entering the cylinder.

8. A toy system, said system comprising one or more figurines, fluid pump means integral to said figurines, pressurized fluid operated equipment, and interfacing means for interfacing said fluid pump means and said pressurized fluid operated equipment, whereby the actuation of said pump means provides pressurized fluid which operates said pressurized fluid operated equipment, said one or more figurines comprising a hollow upper torso section;

a hollow lower torso section;

a solid coupling section fixedly attached to said upper torso section and movably attached to said lower torso section, said coupling section shaped to operate as a piston within said hollow lower torso section;

means for normally holding said coupling section at the top of said lower torso section;

fluid outlet means at the bottom of said lower torso section; and check valve means in said fluid outlet means, whereby pressing down on said upper torso section moves said coupling section from said lower torso section to force pressurized fluid past said check valve means.

9. The toy system of claim 8 wherein said interfacing means comprises base means on said figurine, said fluid outlet means located in said base means, and means in said base means with said outlet means for coupling said outlet means to said pressurized fluid operated equipment.

10. The toy system of claim 9 wherein said interfacing means further comprises means on said fluid operated equipment for coupling to said figurines at said fluid outlet means, fluid actuated means in said pressurized fluid operated equipment, and fluid passageways extending from said coupling means to said fluid actuated means.

11. The toy system of claim 10 wherein said fluid actuated means comprises cylinder means coupled to said fluid passage means, and piston means in said cylinder means operated responsive to receiving pressurized fluid from said figurine.

12. The toy system of claim 11 wherein control means are provided on said pressurized fluid operated equipment for controlling the movement of said piston means.

* * * * *